US005899256A

United States Patent [19]

Rohatgi

[11] Patent Number: 5,899,256

[45] Date of Patent: May 4, 1999

[54] METAL-FLY ASH COMPOSITES AND LOW PRESSURE INFILTRATION METHODS FOR MAKING THE SAME

[75] Inventor: Pradeep K. Rohatgi, Whitefish Bay, Wis.

[73] Assignee: Electric Power Research Institute, Inc., Palo Alto, Calif.

[21] Appl. No.: 08/943,499

[22] Filed: Oct. 3, 1997

[51] Int. Cl.[6] ..... B22D 19/14

[52] U.S. Cl. ..... 164/97; 164/98

[58] Field of Search ..... 164/97, 98

[56] References Cited

U.S. PATENT DOCUMENTS

| | | | |
|---|---|---|---|
| 5,385,195 | 1/1995 | Bell et al. | 164/97 |
| 5,477,905 | 12/1995 | Knapp et al. | 164/97 |
| 5,711,362 | 1/1998 | Rohatgi | 164/97 |

FOREIGN PATENT DOCUMENTS

| | | | |
|---|---|---|---|
| 52-703 | 1/1977 | Japan | 164/97 |
| 90/15681 | 12/1990 | WIPO | 164/97 |

*Primary Examiner*—Patrick Ryan
*Assistant Examiner*—I-H. Lin
*Attorney, Agent, or Firm*—Pennie & Edmonds LLP

[57] ABSTRACT

Metal matrix composites are made by infiltrating packed loose fly ash with molten metal or metal alloy under low pressure. In some embodiments the infiltration is driven by pressurized gas. Coating the fly ash prior to infiltration can lower the threshold of pressure required for satisfactory infiltration by the molten metal. In some embodiments nickel coated cenosphere fly ash is employed. Resulting metal-fly ash composites have high volume fractions of fly ash, and the fly ash is uniformely distributed in the metal matrix. The densities of the composites are relatively low, particularly in composites made using cenosphere fly ash.

18 Claims, 3 Drawing Sheets

METAL-FLY ASH COMPOSITES AND LOW PRESSURE INFILTRATION METHODS FOR MAKING THE SAME

BACKGROUND

This invention relates to metal matrix composites.

Metal matrix composites are materials which include a metal matrix in combination with a secondary phase. The secondary phase acts as a filler or reinforcement in the composite. Metal matrix composites have different and often improved or more desirable properties as compared to their monolithic metal counterparts. For example, depending on the particular metal or metal alloy and secondary phases present in a composite material, as well as their respective ratios in the composite material, the composite material may have improved strength, stiffness, contact wear resistance, and elevated temperature strength, as compared to the corresponding monolithic metal or alloy. And, depending on the choice of reinforcing phase present in the composite, the metal matrix composites may be less costly and have lower density than their monolithic metal counterparts.

There are many potential applications for metal matrix composites. Significant applications of metal matrix composites are likely in automotive components, machine parts, and electronic packaging, as well as in specialized products based on unique combinations of properties.

Of particular interest are metal matrix composites comprising fly ash, because such composites are less expensive to prepare and exhibit improved properties with respect to their corresponding monolithic metal counterparts. Fly ash is an abundant by-product that results from the combustion of pulverized coal. In the past fly ash has been employed as a concrete admixture, as a soil stabilizer, as a filler for asphalt and structural materials, such as bricks. Fly ash is a low density particulate material, classed as precipitator fly ash (solid particles) and cenosphere fly ash (hollow generally spheroidal particles). Fly ash particles are predominantly micron sized, translucent particles which consist primarily of alumina, silica, iron oxides, lime and manganese.

A variety of methods for producing metal matrix composite materials have been developed. These methods include diffusion bonding, powder metallurgy, casting, high pressure infiltration of loose fly ash beds, spray codisposition and the like. For fly ash metal matrix composites in particular, stir casting and high pressure infiltration of loose fly ash beds have found use.

Although a variety of methods for metal matrix composite material production have been developed, these methods are not entirely satisfactory. Conventional techniques for combining metal matrix material and secondary phase material, for example, can result in uneven distribution of the secondary phase in the metal matrix, or inadequate levels of the secondary phase in the matrix; and it is generally difficult to control the amount of the secondary phase which is incorporated into the matrix. These problems have been particularly prevalent in attempts to produce fly ash metal matrix composites by conventional methods.

Rohatgi U.S. Pat. No. 5,228,494 describes making a metal matrix composite by stirring a secondary phase material such as fly ash or oil ash at high speed in a molten metal or metal alloy matrix material to make a slurry of metal and secondary phase material, and then casting the slurry in a suitable mold. The results of attempts using such techniques to obtain metal matrix composites containing more than about 30% by volume of fly ash are not fully satisfactory, because the viscosity of the slurry at higher volume fractions of fly ash becomes too great to permit molding, and because in slowly solidifying castings made by such techniques the fly ash tends to float and to become segregated in upper portions of the resulting cast composites.

Rohatgi U.S. Ser. No. 08/564,517, filed Nov. 29, 1995 and now issued as U.S. Pat. No. 5,711,362, describes combining a fly ash with a binder in an aqueous medium to form a slurry, drying the slurry to produce a solid, porous fly ash-binder preform, then infiltrating the solid preform with a molten metal matrix material, and cooling the metal-infiltrated preform to make a metal matrix composite. This method can yield aluminum-fly ash or lead-fly ash composites having the secondary phase uniformly dispersed within the composite at volume fractions greater than 30% and as high as 70%. However, interactions between metal and binder material may introduce undesirable characteristics in the resulting composite material.

U.S. Pat. No. 5,020,584 describes making metal matrix composite materials by infiltrating a preform of filler material, employing an infiltration enhancer material. Other U.S. patents of interest include U.S. Pat. No. 3,573,940; U.S. Pat. No. 3,585,155; U.S. Pat. No. 4,601,832; U.S. Pat. No. 4,888,054; and U.S. Pat. No. 4,936,270.

SUMMARY OF THE INVENTION

The invention features metal matrix composites made by infiltrating packed loose particulate material, with molten metal or metal alloy under low pressure. In some embodiments the infiltration is driven by pressurized gas. Coating the particulate material prior to infiltration can lower the threshold of pressure required for satisfactory infiltration by the molten metal. The particulate material may include fly ash, and may include precipator fly ash or cenosphere fly ash. Where the particulate material includes a substantial fraction of hollow microspheroids such as for example cenosphere fly ash, coating the particulate material can help reduce intrusion of molten metal into the spheroids material by way of micropores or cracks. In some embodiments nickel coated cenosphere fly ash is employed. Resulting metal-fly ash composites have high volume fractions of fly ash, and the fly ash is uniformly distributed in the metal matrix. The densities of the composites are relatively low, particularly in composites made using cenosphere fly ash.

Packed loose particulate materials can be successfully infiltrated at pressures in the range between about 400 kPa and 700 kPa, such as at pressures of 410 kPa, 550 kPa, and 690 kPa. Infiltration length in a relatively narrow tubular container of the packed loose particulate mass is substantially greater at higher infiltration pressures within this range. However, where the particulate material includes hollow microspheroids, such as cenosphere fly ash, the molten metal invades the centers of a significant proportion of the microspheroids during infiltration, resulting in a higher density composite. I have discovered that successful infiltration can be achieved at pressures lower than 410 kPa, and, in particular, at pressures lower than 100 kPa.

In one general aspect, therefore, the invention features a method for making a metal matrix composite, by contacting a mass of packed loose particulate material with molten metal under pressure in the range from 2 kPa to 410 kPa or less for a time sufficient to effect infiltration of the fly ash mass by the molten metal, usually less than 10 minutes and more usually in the range 1 min. to 5 min., and then permitting the molten metal-infiltrated particulate mass to cool.

In some embodiments the particulate material includes a substantial proportion of hollow microspheroidal particles, that is, of hollow spheroidal particles whose sizes are in the micron range; and according to the invention the metal matrix composite is made at an infiltration pressure in the range from 2 kPa to 100 kPa. In some such embodiments, as where the particulate material includes cenosphere fly ash, for example, the infiltration pressure is sufficiently low that no greater than 98%, more generally no greater that 95%, and still more generally no greater than 90%, of the hollow spherical particles in the resulting composite are infiltrated by the metal; successful infiltration can be achieved at pressures less than 100 kPa, more usually no greater than 40 kPa, and in some embodiments as low as 5 kPa. Usually the particles range in size from 0.5 $\mu$m to 500 $\mu$m, more usually from 20 $\mu$m to 200 $\mu$m.

In some embodiments the metal that forms the metal matrix is aluminum or lead, or an alloy of aluminum or lead. Usually the molten metal is held at a temperature in the range from 10° C. to 500° C., more usually 10° C. to 200° C., above the melting temperature of the metal, during infiltration. For example, where the metal is aluminum or an aluminum alloy, the molten aluminum or alloy is held at a temperature in the range from 500° C. to 1000° C., more usually from 600° C. to 800° C. And, for example, where the metal is lead or a lead alloy, the molten lead or alloy is held at a temperature in the range from 200° C. to 600° C., more usually from 300° C. to 400° C.

In some embodiments the fly ash is coated prior to infiltration. Selected coatings may modify the surface energy of the fly ash and thereby improve wetting of the fly ash particle surfaces by the molten metal during the subsequent infiltration step; additionally or alternatively, where the particulate material includes hollow particles, at least in part, selected coatings may seal cracks or porosities in the wall or shell of the particles. Suitable coatings include, for example, metals such as, e.g., nickel, copper, aluminum, cobalt, zinc, tin, gold, silver; and alloys, oxides, carbides, nitrides of such metals. The particles can be coated by, for example, electrochemical deposition, or vapor deposition, or blending with mteal powder and ball milling, or by any of a variety of particulate coating processes. One suitable coating techniques consists of decomposing a metal carbonyl in a bed of the loose particulate material. The carbonyl process consists of exposing a fluidized bed of the particles to vapors of a metal carbonyl. The carbonyl decomposes, leaving a coating of the metal on the surfaces of the particles. Following decomposition of the metal carbonyl the carbonyl gas can be used to form more metal carbonyl for use in coating.

Methods according to the invention can provide for satisfactory pressure infiltration of molten metal throughout the packed unbound secondary phase over suitably short infiltration times at low pressures. Where the secondary phase material particles are coated prior to the infiltration step, even lower pressures are required for satisfactory infiltration. Lower pressure infiltration is much more commercially feasible than conventional higher-pressure infiltration, because much simpler and less costly equipment, requiring lower cost tooling, is required to generate and to maintain the lower pressures. Moreover, where the secondary phase material is cenosphere fly ash, a lesser proportion of the hollow spherical fly ash particles are ruptured at the lower pressures employed according to the invention than at conventional higher infiltration pressures, and infiltration by the molten metal into the interiors of the hollow spherical particles is reduced. The resulting composite materials have higher volume fractions of secondary phase material, and substantially lower densities.

Accordingly, in another general aspect the invention features a metal matrix composite including a metal matrix and a fly ash secondary phase, in which the volume fraction of the fly ash in the composite is greater than 20%, more usually greater than 50%. The density of the composite is less than 80%, more usually less than 70% of the density of the matrix metal alone.

In some embodiments the metal matrix of the composite is aluminum or lead or an alloy of aluminum or lead. The density of the lead-cenosphere fly ash composite is less than 10 g/cm$^3$, and in some embodiments is as low as 7 g/cm$^3$, and may be as low as 4 g/cm$^3$. The density of the aluminum-cenosphere fly ash composite is less than 2.4 g/cm$^3$, and in some embodiments is less than 2.0 g/cm$^3$, and may be as low as 1.2 g/cm$^3$.

In the metal matrix composites according to the invention the secondary phase is uniformly dispersed and present at high volume fractions, yet according to the invention there is no necessity to mechanically stabilize the mass of secondary phase material by use of binders or the like. Consequently, the process of making the composites is simplified and made less costly by omission of a binder step, and no binder material is present to interact unfavorably with the metal. Some composites of the invention have higher hardness, stiffness, and damping capacity than the corresponding metal matrix materials alone. And some composites according to the invention have reduced thermal expansion coefficients than the corresponding metal matrix materials alone.

DETAILED DESCRIPTION

GAS DRIVEN PRESSURE INFILTRATION APPARATUS

The method of the invention for infiltration of fly ash by molten metal entails providing and supporting a mass of packed loose fly ash, contacting the fly ash mass with molten metal, and applying pressure to drive the molten metal into the interstices of the fly ash mass.

Figure 1:
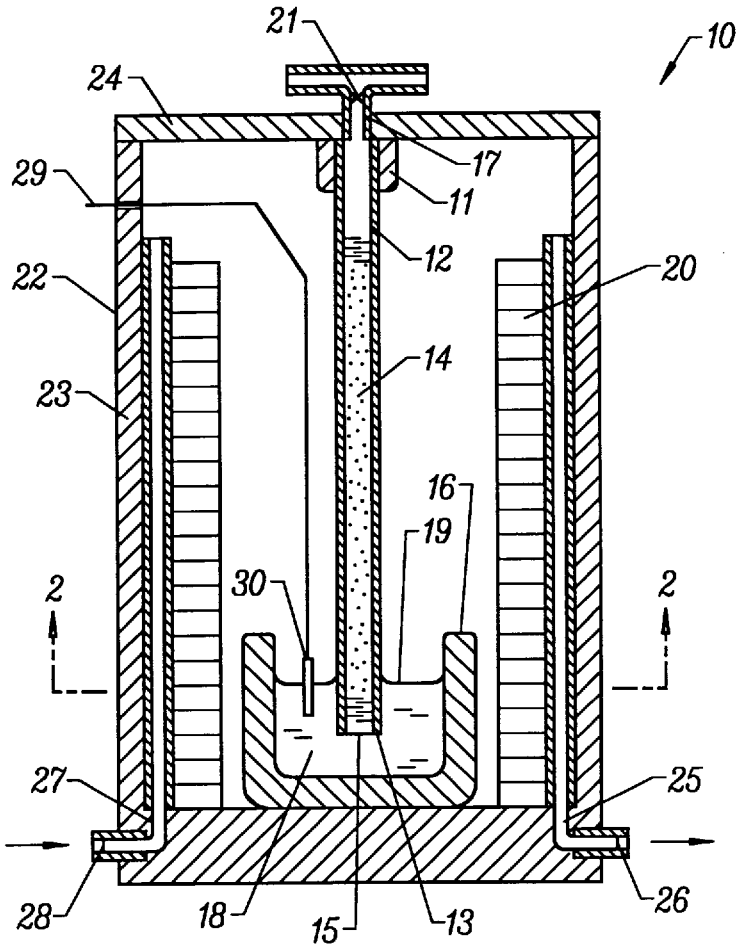
FIG. 1 is a sketch showing apparatus for carrying out a low pressure infiltration of packed loose fly ash as a step in making a metal matrix composite according to the invention, in a diagrammatic axial sectional view.
Figure 2:
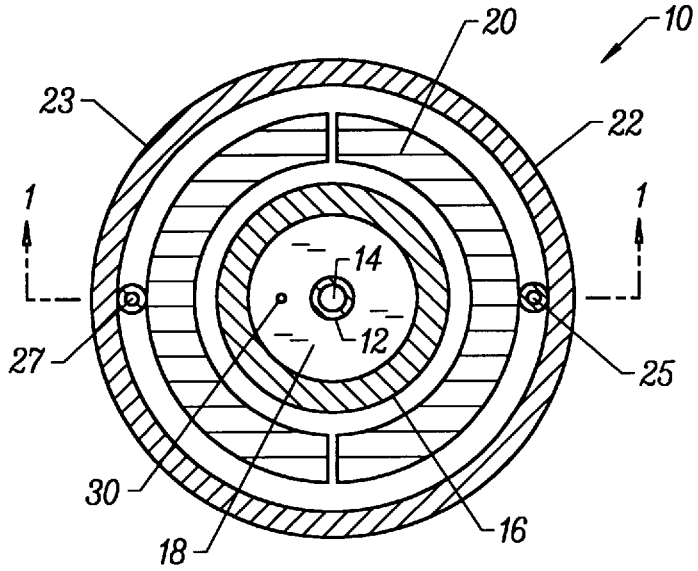
FIG. 2 is a sketch showing apparatus as in FIG. 1, in a diagrammatic transverse sectional view thru 2—2 in FIG. 1.

FIGS. 1 and 2 are diagrammatic sectional views of apparatus, shown generally at 10, suitable for carrying out the infiltration method of the invention. Briefly, sample container 12 for supporting the packed fly ash mass 14 and crucible 16 in which the molten metal 18 is held are surrounded by heating element 20 within pressure chamber 22, which has walls 23 and removable cap 24. The sample container 12 is suspended from cap 24 of pressure chamber 22 by a specimen holder 31, to which upper end 11 of sample container 12 is sealed. The lower end 13 of sample container 12 extends downward into crucible 16, to immerse the lower end 13 of sample container 12 into, and some distance below the surface 19 of, the molten metal 18, so that the lower end 15 of the fly ash mass 14 contacts the molten metal 18. The interior of sample container 12 is open by way of port 17 through cap 24 of pressure chamber 22 to valved outlet 21. The interior of pressure chamber 22 is open by way of port 25 to valved vent 26, and by way of gas inlet port 27 to valved gas supply line 28 receiving gas from a source (not shown in the Figs.) under pressure. A temperature sensor 30 is situated within crucible 16 for monitoring the temperature of the molten metal 18, and connected by way of conduit 29 to temperature display or recording means, and to temperature control means (not shown in the Figs.) connected to the heating element 20. Means (not shown in the Figs.) are also provided for monitoring the pressure within chamber 22; such pressure monitor means may be associated directly with the chamber wall 23 or cap 24, and/or with the gas source or supply line 28, or with the vent 26. The apparatus 10 may also be provided with cooling means (not shown in the Figs.).

When the apparatus is assembled, with the lower end of the sample container immersed in the molten metal, the molten metal effectively provides a fluid barrier between the space within the sample container above the molten metal and the space outside the sample container and within the pressure chamber. Accordingly, if the vent is closed, introduction of gas into the assembled pressure chamber by way of the gas inlet will raise the chamber pressure outside the container and will cause a pressure differential that, if maintained sufficiently high, will force the molten metal up through the fly ash mass within the container.

Generally, then, the apparatus operates as follows. A quantity of fly ash material is put into the container and compacted as desired, and then the compacted fly ash mass is constrained above and below by a material that is permeable to the molten material but does not permit the fly ash material to pass through. The cap is removed from the pressure chamber, and the container with the compacted fly ash mass is sealed to the cap by means of the specimen holder. A quantity of metal is melted in the crucible, and then the cap is placed upon and sealed on the chamber wall, with the lower end of the container immersed in the melt. The heating element is then activated to heat the assembly and, particularly, to bring the powder compact up to the temperature of the molten metal. Then, with the vent closed, gas is introduced from the source into the chamber until the desired infiltration pressure over the surface of the molten metal is reached. The outlet from the chamber is open during infiltration, so that the pressure within the sample container, including the interstitial pressure of the fly ash melt, is lower than the pressure over the molten metal surface outside the sample container. The pressure differential causes the metal to move upward into and through the fly ash mass until the pressure difference is no longer sufficient to overcome the resistance to flow. Then the apparatus is cooled to solidify the metal in the molten metal-infiltrated fly ash mass, and finally the resulting matrix metal composite is removed from the sample container.

The following examples are offered by way of illustration and not by way of limitation.

EXAMPLES

Example 1

Aluminum-Cenosphere Fly Ash Composite

This Example illustrates preparation of aluminum-cenosphere fly ash composites by gas-driven low pressure infiltration, using apparatus generally as described above with reference to FIGS. 1 and 2.

A. Apparatus

The apparatus employed in this Example is as follows. The pressure chamber wall is a stainless steel cylinder with inside diameter 18 cm, outside diameter 19.7 cm, and length 27.5 cm. The cap and the wall are surrounded externally with copper tubing, connected to a source of cold water, for cooling. The furnace, which operates at 1700 W, consists of two semi-cylindrical electrical resistance heating elements axially disposed about the cylindrical axis of the pressure chamber. The temperature is controlled by a temperature controller. The applied pressure is monitored using a pressure transducer and a digital pressure indicator.

The melt is held in a graphite crucible resting at the center of the circular bottom of the chamber. The specimen holder is attached to the center of the inner (lower) surface of the circular cap of the pressure chamber and the sample container (described below) is fitted snugly in the specimen holder using a small o-ring. When the cap is placed upon the pressure chamber the lower end of the sample container is immersed to a depth of 2 cm in the melt.

B. Preparation of the Cenosphere Fly Ash Mass

The cenosphere fly ash mass was prepared in this Example as follows. Cenosphere fly ash was supplied from a coal-fired electrical power utility. Chemical analysis of the fly ash indicates $SiO_2$ 60 wt %, $Al_2O_3$ 26 wt %, and a very small proportion of iron oxide. Using scanning electron microscopy, these particles appear nearly spherical, and most of the particles measure larger than 63 $\mu$m. The bulk density of the particles as received from the supplier is about 0.36 g/cm$^3$, the tap density is about 0.38 g/cm$^3$, and the true density as measured by Pycnometer is about 0.58 g/cm$^3$.

The sample container used in this Example is a quartz tube having inner diameter 6 mm and length about 25 cm. First, the fly ash particles as received were prepared by drying in an electric resistance furnace at a temperature of 700° C. for 2 hours. Then about 2 g of the loose cenosphere fly ash particles were poured into each quartz tube sample container, and packed by tapping the quartz tube against a plane surface with a fiber blanket blocking one end of the tube. After packing, the side of the compact to be in contact with the melt was plugged with fiber blanket to help prevent depacking of the particles, and to skim any oxides off the aluminum melt. Then the quartz tube containing the compressed loose cenosphere fly ash mass was mounted onto the pressure chamber cap as described above.

C. Infiltration of the Melt into the Compressed Fly Ash Mass and Cooling to Form the Composite Aluminum (99.9% purity) obtained from Aldrich Chemical Company, Inc. was used for the preparation of composites in this Example. Infiltration was carried out as follows.

The aluminum is melted in the crucible, and the top of the melt is skimmed off. Then the pressure chamber cap, mounted with a packed quartz tube sample container as described in Example 1.B. above, is placed over the top of the chamber so that the packed tube is immersed into the melt as described in Example 1.A. above. The specimen is preheated inside the pressure chamber for a time sufficient to achieve isothermal conditions in the compacted fly ash mass, and to reduce the likelihood of freeze-choking.

Then argon gas is introduced into the chamber by way of the gas inlet port to raise the pressure over the surface of the melt at a constant rate (20 kPa/sec) up to pressures of 410 kPa, 550 kPa, and 690 kPa. Once the set pressure had been reached, it was maintained for a time up to several minutes, usually in the range 1 min. to 5 min. At the end of infiltration time the argon gas in the pressure chamber is vented out through the vent. Finally the lid of the pressure chamber is removed, and the tube containing the specimen is removed from the specimen holder and allowed to cool in air. Once the infiltrated specimen has cooled, the quartz tube is broken carefully to obtain the composite specimen.

D. Infiltration Length

Under the conditions outlined in Example 1.C. above, infiltration proceeds successfully to different lengths within the fly ash mass under the different conditions. Generally, the infiltration length of a composite is a function of the character of the particles of the secondary phase material, matrix alloy, the applied infiltration pressure and the temperature of infiltration.

In this Example, infiltration length was measured directly on each specimen using a linear scale. Generally, at any given temperature, as the applied pressure increased, the infiltration length increased. At 800° C., for example, the infiltration length increased from 14.7 cm to 17.3 cm as the pressure increased from 410 kPa to 690 kPa. Similarly, at 700° C., the infiltration length increased from 6.6 cm to 6.8 cm as the applied pressure increased from 410 kPa to 550 kPa. It appears that, at various applied pressures, the infiltration length is much greater at higher temperatures; for instance at a pressure of 410 kPa, the infiltration length at 700° C. infiltration temperature is 6.6 cm, while the infiltration length at 800° C. is 14.7 cm.

E. Volume Fraction of Fly Ash in the Aluminum-Cenosphere Fly Ash Composite

The volume fractions of cenosphere fly ash particles in aluminum-cenosphere fly ash composites made as described in Example 1.C. above were determined by image analysis on polished samples using a LECO 2001 Image Analyzer. Standard polishing procedures were followed, using SiC grinding papers of 180, 240, 320, 400, and 600 grits. Final polishing of the samples was done using a micro polishing cloth with a $SiO_2$ suspension slurry of 0.05 $\mu$m particle size. Three pictures were quantitatively analyzed from one sample. The average of the volume percentage of cenosphere fly ash for these specimens was 59.2%, and the matrix was 40.7%. Thus, about 60 volume percent of matrix aluminum is replaced by fly ash in these composites, representing savings in energy intensive aluminum metal.

F. Density of the Aluminum-Cenosphere Fly Ash Composite

The apparent densities of the aluminum-cenosphere fly ash composites made as described in Example 1.C. above were calculated from according to Archimedes' Principle by weighing samples immersed in water. Samples were taken from various points along the length of each specimen. A digital scale with a minimum count of 0.1 mg was used. Before weighing, the samples were degreased with acetone.

The density is calculated by:

$$\rho=\rho_{water}\cdot W_{Air}/(W_{Air}-W_{water}), \quad (1)$$

where $\rho$ is the specimen density, $\rho_{water}$ is the water density $W_{Air}$ is weight of the sample in air, $W_{water}$ is weight of the sample in water.

The average density of samples made as described in Example 1.C. above was 1.4 g/cm$^3$. The density of aluminum is 2.68 g/cm$^3$, and thus the density of the aluminum-cenosphere fly ash composites made according to the invention is 52% of the density of aluminum. There is some variation in densities of samples taken from different positions along the length of the specimens. Particularly, the density of particular specimens of aluminum-60% cenosphere fly ash composite decreased with increasing distance from the bottom of the infiltrated sample. This may owe to progressively increasing porosity in more upper parts of the sample.

G. Hardness and Microhardness

Hardness and microhardness of samples taken from various positions along the length of specimens made as in Example 1.C. above were measured as follows. Each sample surface was polished to 600 grit. Hardness was measured using a Rockwell type hardness tester equipped with a ¼ in. diameter steel ball indenter, loading each sample with 60 kg for 10 seconds. The L scale Rockwell hardness (HRL) was read directly from the test machine.

Samples from lower portions of each specimen are comparatively higher than from upper portions, apparently corresponding to the higher densities lower in the specimen, as described above.

Microhardness measurements were made on polished samples using a Micromet II Digital Microhardness Tester equipped with a Knoop diamond indenter. The optical system was completely adjusted before any measurements. The sample was loaded with 25 g for 13 seconds. The indentation diagonal was measured at a magnification of 400×. The microhardness (HK) was read directly from the indicator.

Microhardness measurements were made on the aluminum matrix between cenosphere fly ash particles, or within cenosphere particles which were infiltrated by aluminum matrix.

The microhardness values of aluminum-cenosphere a fly ash infiltrated specimen and a pure aluminum specimen, both produced at 700° C. and 550 kPa, were compared. In this comparison the microhardness of the aluminum matrix in the infiltrated aluminum-cenosphere fly ash composite specimen was 70 HK, more than twice as hard as that of the pure aluminum, which was 31 HK. The greater hardness of the metal matrix aluminum-cenosphere fly ash composite may be owing to alloying elements (such as Si) reduced from fly ash by the molten aluminum during infiltration and present in the aluminum matrix in the composite.

H. Compressive Strength

Compression strengths of specimens made as described in Example 1.C. above were made on 6 mm diameter, 8 mm long samples using a MII-50UD universal testing machine operating at a constant moving rate of 0.02 inches/minute at room temperature. Compressive strength and compressive modulus were measured for samples in the as-cast condition. To reduce the effect of friction of sample surface on the testing results, two end surfaces of the sample were polished using SiC grinding papers of 180 and 240 grits.

Generally, the compressive modulus and compressive strengths were lower at more upper portions of each specimen. The variation in the modulus with length is similar to the variation in hardness and the density along the length as discussed above. Similarly, as the density decreases, the hardness and compressive strength decreased as well.

Example 2

Lead-Cenosphere Fly Ash Composite Made By Gas-Driven Low Pressure Infiltration In this Example, gas driven low pressure infiltration apparatus was employed, generally as described in Example 1 above, to prepare a lead-cenosphere fly ash composite.

Briefly, a cenosphere fly ash mass was prepared generally as described in Example 1.B. above, and the quartz tube containing the compressed fly ash mass was mounted in the cap of a pressure chamber constructed generally as described in Example 1.A. above. Lead was melted in a crucible, and the infiltration apparatus was set up generally as described in Example 1.C. above, except that nitrogen gas was used to drive the pressure, rather than argon.

The pressure required to infiltrate molten lead into cenosphere fly ash under the conditions described here is in the range between about 10 p.s.i. and about 50 p.s.i. (69 to 345 kPa).

The resulting lead-cenosphere composite specimens were sectioned at different locations along their length, and mounted with dry phenolic powder (METLAB Corp.) in a Buehler compression mounting press at temperatures near 150° C. and under pressures between 3,000 p.s.i. and 4,200 p.s.i.

Standard grinding procedures were followed, using SiC grinding papers with grit size of 180, 240, 320, 400, 600. Final polishing of the sample was done by applying a thin layer of 1 $\mu$m METLAB medium concentration diamond suspension on a lapping film. The microstructure of the composite in the polished samples was examined using an optical microscope BH2-UMA (OLYMPUS Corp.).

The lead-cenosphere fly ash composite made in this fashion is a rod having a diameter about 6 mm and a length about 15.88 cm, and a mass about 16.35 g. The surface of the specimen appears to be covered by pure lead. The average density of the specimen was calculated as approximately 3.64 g/cm$^3$, compared to a density of 11.35 g/cm$^3$ for pure lead. The volume fraction of the fly ash in the composite would be approximately 71.1% by calculation, assuming no porosity in the composite. The total volume fraction of the cenosphere fly ash in the composite is calculated to be approximately 69.2 volume %. The discrepancy suggests that there is some porosity in the matrix as well as matrix free uninfiltrated region near the top of the specimens; this is confirmed by microscopic examination.

Optical microscopy of samples taken from various points along the length of the specimens, and at various locations near the surface and near the center of the specimens, reveals some inhomogeneity in these composites.

Samples from near the bottom of these specimens show that the composite constitutes a rind of pure lead in a zone at and just beneath the outer surface, and that fly ash particles are dispersed beneath the rind and into the center of the specimens. Comparison of samples from various points along the length of the specimens shows that the fly ash cenospheres are more abundantly dispersed in upper portions of the specimen than in middle and lower portions. Moreover, the particles appear to be more agglomerated in upper portions as compared with lower portions, apparently owing to the flow of molten lead during pressurization time. The molten lead carries the smaller cenospheres to the upper portions of the composite. The thickness of the surface rind of pure lead decreased progressively from the bottom to the top of the specimen. The presence of a rind in lead matrix composites may in itself provide structural advantages in some aplications, as, for example, in storgae battery uses.

Example 3

Comparison of Composites Made By Low Pressure Infiltration of Aluminum into Fly Ash Masses Made From Uncoated and From Nickel Coated Cenosphere Fly Ash Materials Examination of hollow generally spherical cenosphere fly ash particles by scanning electron microscopy reveals that the walls of the particles are porous, the pores being generally circular with diameters in the range 1 $\mu$m to 13 $\mu$m. These porosities are expected to affect the processing as well as properties of the resultant composite materials. In this Example, fly ash masses made using uncoated and nickel coated cenosphere fly ash were infiltrated under comparable processing conditions to determine whether using nickel coated fly ash reduces intrusion of the molten aluminum through porosities or cracks in the surface of the particles. This Example illustrates differences in selected processing parameters and in selected characteristics of aluminum-cenosphere fly ash composites made using nickel coated and uncoated cenosphere fly ash materials in preparation of the fly ash mass.

A. Apparatus

The apparatus employed in this Example is substantially the same as that described in Example 1.A. above. The sample container used in this Example differs from that described in Example 1.B. above in some respects, described below.

B. Preparation of Coated and Uncoated Cenosphere Fly Ash Mass

Uncoated and nickel coated cenosphere fly ash masses were prepared for this Example as follows. Cenosphere fly ash was obtained from an electric power facility and was size-sorted into various particle size ranges.

The sample container used in this Example is a borosilicate tube with inner diameter approximately 6 mm and length about 23 cm. To prevent reaction between the molten aluminum and the silicate tube, the inner surface of the tube wall was coated with a thin layer of $ZrO_2$ as follows. A slurry of $ZrO_2$ and tap water was mixed in a ratio approximately 10:1. Each tube was first filled with this mixture, and then allowed to empty, leaving a wet coating on the inner wall surface. Then the tube is mounted in a fixture on a lathe and turned while the coating air dries, to ensure a relatively uniformly coated inner surface. A small air flow is supplied to help speed the drying process. The tube is then allowed to further air dry for three days' time to avoid water vapor bubbling when the tubes are put in the oven for infiltration.

After the fly ash was separated into the selected particle size ranges, it was packed into the sample containers, prepared as described above. For loosely packed samples, 2 grams of fly ash are placed in each tube and then the tube is lightly tapped five times on a flat surface. For tightly packed samples, the fly ash is put into the tube and tapped until the fly ash does not compact any further by tapping; using these materials, tapping for about fifteen minutes' time suffices. Then the two ends of the tube are packed with a fiber blanket to guard against displacement of the particles and to capture the oxide layer from the top of the aluminum melt as it infiltrates the fly ash bed. The length of the compacted fly ash bed was measured and the packing density was calculated based on the volume and weight of the fly ash. The packed tubes were dried for at least 30 minutes in a furnace at 150° C. to 200° C. prior to infiltration. Then the borosilicate tube containing the compacted loose cenosphere fly ash mass was mounted onto the pressure chamber cap using a Teflon seal.

Coated fly ash was made in this Example by decomposing nickel carbonyl gas in a fluidized bed of fly ash.

C. Infiltration of the Melt into the Compressed Fly Ash Mass and Cooling to Form the Composite Aluminum (99.9 wt % purity) obtained from Alcoa was placed in a coated graphite mold and placed within the resistance furnace of the infiltration setup. The aluminum melt is skimmed to remove oxide. Then the pressure chamber cap, mounted with the preheated compressed loose fly ash mass in the sample container, is secured over the top of the chamber and sealed using a silicon gel and O-ring.

A vacuum was drawn in the pressure chamber, but not within the sample container. The system is preheated for three minutes and then nitrogen gas is introduced into the pressure chamber to raise the pressure over the melt surface to a pressure in the range 21 kPa to 69 kPa (3 p.s.i. to 10 p.s.i.). Pressurization was achieved within approximately 5 seconds, and was thereafter maintained at the prescribed setpoint. After the sample was held under constant pressure for a period of time in the range 1 to 9 minutes, the pressure was released and the apparatus was opened. The sample was then removed and allowed to slowly cool to room temperature. It should be noted that this infiltration is not isothermal.

D. Density of Infiltrated Samples

Specimens were sectioned into approximately equal sample segments, and the density was determined by weighing the segments, measuring the volume and then calculating the resulting density.

The relative volume fractions of fly ash particles in the composites were estimated by comparing the areas in the sections of the sample microstructures filled by the fly ash to the total area of the sample microstructures. This was calculated for upper, middle and lower sample segments of composite specimens made from nickel coated and uncoated fly ash particles. The volume fractions of fly ash as estimated from area fractions of fly ash particles were very consistent throughout the specimens, from the upper to the lower samples, in the range 50–60 volume percent throughout the length of the samples.

E. Microstructure of the Composites

Optical microscopy and scanning electron microscopy (SEM) were used to examine the microstructure of samples taken from both uncoated and nickel coated fly ash composite specimens, and the analysis was conducted in samples from both the upper and lower portions of the specimens. Spectrographic analysis was also carried out using SEM to determine the elemental ratios of the phases found in the matrix. Additionally the EDS was used to determine the overall nickel gradient in a sample made using nickel coated fly ash, by taking readings of 1 mm square areas. The SEM averaged the chemical compositions at a given level of the sample and established overall ratios among the elements present. A Topcon SEM, ABT-32, equipped with an energy dispersive spectrometer (EDS) attachment from HNU Systems at approximately 25 keV, was used for the SEM and the spectrographic analysis. No conductive deposition was used, and thus occasional charging of particles occurred. X-ray diffraction was also used to identify the phases present in selected composite samples.

Photomicroscopic examination of aluminum—60 vol % uncoated cenosphere fly ash composites made by pressure infiltration at 34.4 kPa and at 689 kPa demonstrated good contact between the aluminum matrix and the surface of the fly ash particles at both pressures. However, in samples of composites made by infiltration at 34.4 kPa, in regions near the contact surfaces of two touching fly ash particles some lack of infiltration (porosity) occurs. The very small interparticle distances at contact surfaces necessitate very high pressures for infiltration.

In composites prepared by infiltrating uncoated fly ash by molten aluminum at lower pressures, in the range of 30 kPa–70 kPa (4 p.s.i. to 10 p.s.i.), voids appear in some places, each consisting of a cluster of several fly ash particles which were not infiltrated by molten aluminum. The frequency of occurrence of these large agglomerations of fly ash was much lower in samples from specimens made at higher infiltration pressures, e.g., 689 kPa. Fewer such agglomerations also appeared in samples made by infiltrating nickel coated fly ash particles.

The interiors of some of the cenospheres were infiltrated by molten aluminum, presumably by way of large cracks or pores in the fly ash particle surface. Infiltration of molten aluminum into the hollow center of a significant number of the cenospheres will result in an increased density of the composite. In selected experiments at an infiltration pressure of 689 kPa, the fraction of uncoated fly ash cenospheres that were filled with aluminum during infiltration was very high. By contrast, aluminum filled cenospheres was very rare for the infiltration of the particle mass at lower pressures, such as 34.5 kPa. Thus, while higher infiltration pressures may result in a lower incidence of porosity between the particles, higher infiltration pressures may increase the proportion of fly ash particles that are filled with aluminum. Accordingly, an optimum infiltration pressure for making a low density composite under a given set of processing conditions is one selected between a higher pressure that results in filling a significant fraction of cenospheres and a lower pressure that results in insufficiently complete infiltration of the interstices between the particles (porosity in the matrix).

The uncoated fly ash as received contained approximately 5% iron oxide. Some of this iron was within the walls of the fly ash as part of the glass or ceramic. The remaining iron oxide was present either as separate particles of iron rich oxides or as iron rich deposits attached to the surfaces of the fly ash particles. During infiltration by the molten aluminum, the iron tied into the glass or ceramic wall of the cenosphere presumably does not react with the molten aluminum to any significant extent. However, the iron oxide present in the fly ash as separate particles either mixed or attached to the surface of fly ash is able to react with molten aluminum to form iron compounds, as a result of reduction of iron oxide with molten aluminum; this iron is transported to the top of the infiltrated samples where it precipitates as iron aluminum intermetallic compounds.

Needle- and platelet-shaped intermetallic phases appeared in samples from upper portions of composite specimens. Chemical analysis by EDS revealed that these structures contain aluminum, iron and silicon. Such needles and platelets were not present in samples from lower portions of the aluminum-uncoated fly ash composite specimens. Apparently, as the flow of molten aluminum infiltrates the lower part of the fly ash mass, the available iron begins to dissolve, and is transported to the top of the sample with the flowing stream of aluminum. The aluminum stream thus enriched with iron solidifies near the top of the sample, leading to the precipitation of the iron rich needles or platelets. This results in a concentration gradient of iron from the bottom to the top of the infiltrated sample. Such concentration gradients have been reported by D. C. Downwind et al. (1993), *Metal Mater. Trans. A*, vol. 24A, pp. 2161–70, in composites made by infiltrating nickel spheres and nickel coated silicon carbide with molten aluminum.

While microscopic analysis of aluminum—uncoated cenosphere fly ash samples showed a higher degree of particle agglomeration near the bottom of the sample than in the middle and near the top, microscopic analysis of the aluminum—nickel coated cenosphere fly ash composites shows a marked reduction in the amount of agglomeration throughout the sample. Particularly, only small amounts of agglomeration appear in lower samples from a specimen made with nickel coated fly ash, where the coating has been washed away by the flow of the aluminum. Erosion of the nickel coating is evidenced by a rough appearance of the cenosphere surfaces in the lower samples. In samples from near the top of the specimens made with nickel coated particles, the surfaces of the cenospheres appear smooth and spherical owing to the residual nickel coating on their surfaces.

SEM was used to examine the microstructures of samples from upper and lower portions of aluminum—nickel coated cenosphere fly ash composite specimens. Plate-shaped phases are present in the matrix in the upper samples; they are absent from the matrix in lower samples. In addition, regions near some of the contacting fly ash particles in the upper samples are poorly infiltrated. The ratio of nickel to aluminum in the platelets which are dispersed in the matrix in the top part of the sample suggests that they are $NiAl_3$; the presence of $NiAl_3$ was further confirmed by X-ray diffraction. The needle-like structures contain the same ratio of nickel and aluminum, but additionally contain some iron. The majority of the fly ash particles at the top of the sample have a very thin layer of pure nickel remaining as a coating around the cenospheres. The matrix contains primarily aluminum.

In contrast, analysis of the lower sample from this same specimen revealed no evidence of $NiAl_3$, nor any evidence of nickel in any form. Moreover, in this lower sample there are no intermetallic phases in the matrix; the matrix here is single phase aluminum with no evidence of nickel or iron. X-ray diffraction revealed no evidence of nickel in the matrix or on the surface of the fly ash particles. Apparently the nickel that had been present on the fly ash particles in the compressed fly ash mass prior to infiltration was dissolved away from this portion of the specimen by the flow of the aluminum melt. The lower end of the sample was submerged in the aluminum melt during the preheat. The melt was held at 800° C. and thus melted away the nickel coating from the fly ash particles in the bottom of the sample.

Figure 6:
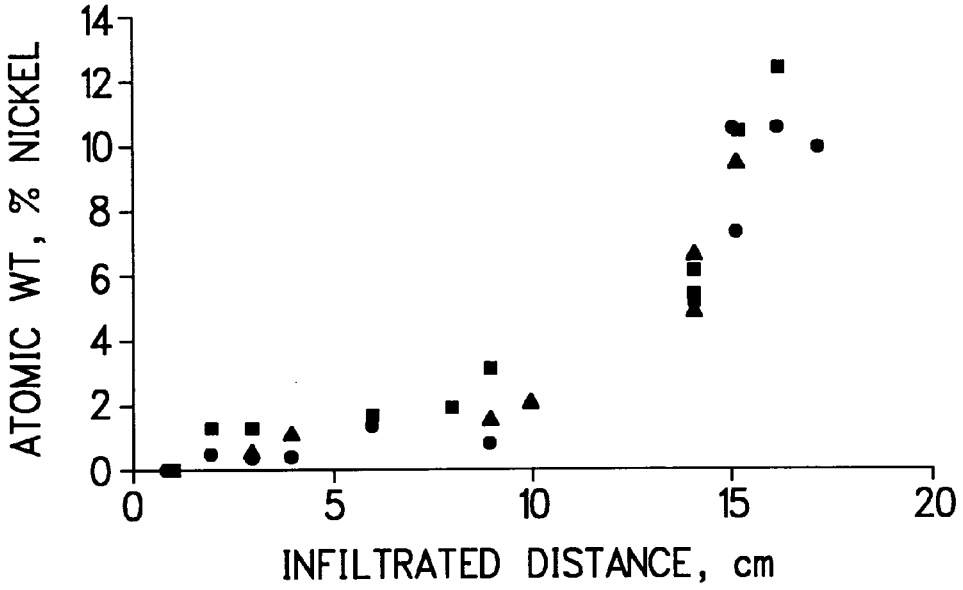
FIG. 6 is a plot of data showing concentrations of nickel at various points across transverse sections (surface measurements indicated by squares, ■, and ovals, ●; center measurements indicated by triangles, ▲) prepared from samples from various points along the infiltration length of an aluminum-cenosphere fly ash composite made by molten aluminum infiltration of nickel coated cenosphere fly ash.

The nickel gradients in composite specimens made using nickel coated fly ash particles was analyzed using EDS. Five sections along the length of the specimen were tested to determine their overall nickel content. Several measurements were taken at different locations on each section. The results are presented in FIG. 6. As FIG. 6 shows, the nickel concentration in the composite increases from the bottom to the top of the specimen. This results from the flowing aluminum melt dissolving the nickel away from the nickel coated fly ash particles in lower parts of the sample and carrying it to the top of the sample. The drop of nickel in aluminum to zero per cent at the bottom was a result of this part of the sample being immersed in the 800° C. melt and held for three minutes while the sample was preheated. The dramatic increase of nickel at the very top of the composite sample made using nickel coated fly ash was caused by the precipitation of nickel rich phases from the aluminum, which became enriched in nickel owing to the dissolution of nickel from the surfaces of the fly ash particles in the lower part of the specimen.

There are substantial variations in nickel concentration over the transverse sections of the sample. The range of this variation is much smaller than range of the gradient from top to bottom of the specimen. The variation in nickel content across the transverse sections may be a result at least in part of a flow of nickel enriched aluminum along the wall of the sample tube during pressurization.

F. Threshold Pressure for Infiltration; Infiltration Length

In this Example, infiltration was attempted at several pressures over a broad range, to determine the threshold pressure for infiltration under these conditions. Using uncoated particles of intermediate size (180–250 $\mu$m), a set of 8 infiltration runs was carried out, at pressures in the range 68.94 kPa to 20.68 kPa. The samples had an average packing density of 0.382 g/cm$^3$, and a melt temperature of approximately 800° C.

The results are shown in Table I.

TABLE I

Infiltration lengths for infiltration of pure aluminum into fly ash masses made from uncoated spheroid fly ash particles

| Run No. | Pressure, kPa | Infiltration Length, m |
|---|---|---|
| 1 | 68.94 | 0.19 |
| 2 | 68.94 | 0.19 |
| 3 | 48.26 | 0.16 |
| 4 | 41.36 | 0.17 |
| 5 | 27.58 | 0 |
| 6 | 34.47 | 0.17 |
| 7 | 27.58 | 0 |
| 8 | 27.58 (held constant) | 0.04 |

Figure 3:
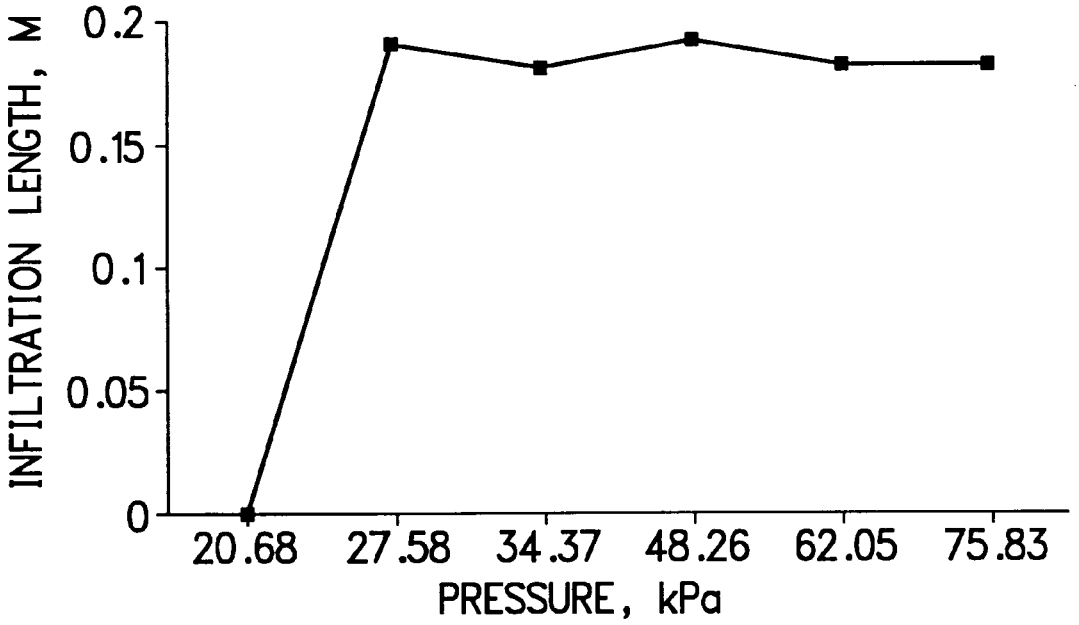
FIG. 3 is a plot of data showing the extent of aluminum infiltration into uncoated cenosphere fly ash at various infiltration pressures, as described in Example 3. Average particle size, 145 $\mu$m; infiltration for 5 min. (average) at 800° C.

Under these conditions, the threshold pressure for infiltration of uncoated cenosphere fly ash of particle size in the range 180–250 $\mu$m is at some pressure between 20.68 kPa and 27.58 kPa. In subsequent runs (data not shown), good infiltration was consistently achieved at a constant pressure of 27.58 kPa, and that infiltration does not occur at a pressure of 20.68 kPa held for 10 minutes. FIG. 3 presents the data of Table I in graphical form. As FIG. 3 illustrates, infiltration length is abruptly higher at 27.58 kPa than at 20.68 kPa.

Figure 4:
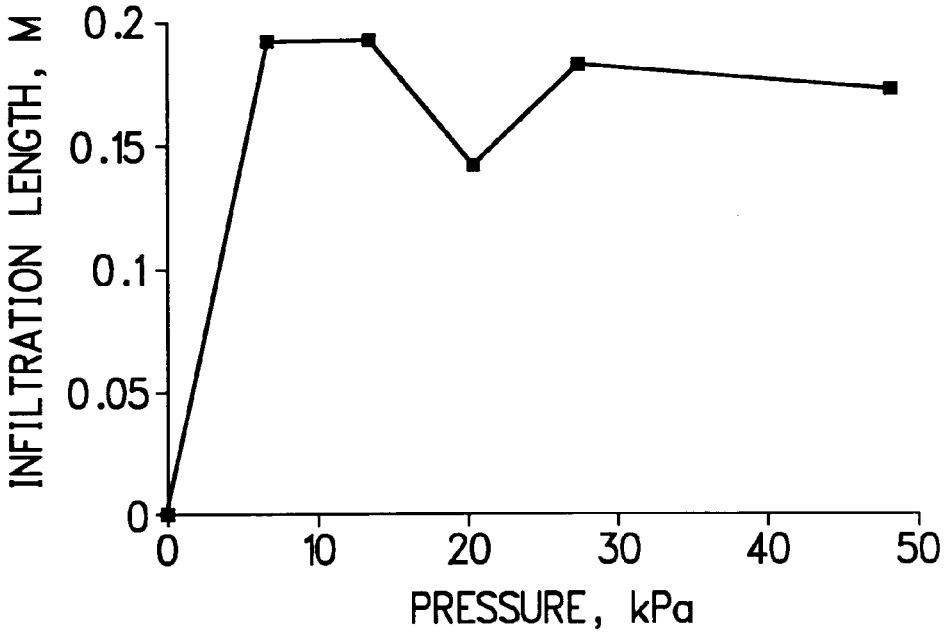
FIG. 4 is a plot of data showing the extent of aluminum infiltration into nickel coated cenosphere fly ash at various infiltration pressures, as described in Example 3. Average particle size, 145 $\mu$m; infiltration for 5 min. (average) at 800° C.

FIG. 4 presents data obtained from similar aluminum infiltration runs in fly ash masses made using nickel coated cenosphere fly ash. Here the threshold pressure for infiltration is between 0 kPa and 6.89 kPa, which is significantly lower than the threshold pressure found for infiltration of uncoated fly ash under these conditions.

The threshold pressure was determined experimentally, and is used to calculate the contact angle between aluminum and fly ash. The Young—Laplace equation (2), and the Washburn equation (3) have been used to solve for the effective contact angle between the molten aluminum front and the bed of fly ash particles:

$$P_{th}=2\sigma_{LV}\cos\theta/r_c \quad (2)$$

$$L^2=(\rho r^{e2}4\eta)[(2\sigma_{LV}\cos\theta)/(\rho r_e)-gL+P_{app}/\rho]t \quad (3)$$

Table II gives the values of the contact angle as they were back calculated using these equations and the information gathered from many different samples. The average effective wetting angle for uncoated cenosphere fly ash as calculated is approximately 111°. This is very close to the contact angle between molten aluminum and a variety of ceramics, see, T. M. Valentine (1977), *Mater. Sci. Eng.*, vol. 30, p. 211; J. J. Brennan et al. (1968),vol. 51, p. 569; V. Laurent et al. (1987), *Jour. Mater. Sci.*, vol. 22, p. 244.

TABLE II

Wetting angles of selected ceramics with molten aluminum

| Ceramic | Temperature, ° C. | Average wetting angle |
|---|---|---|
| SiC | 870 | 150° |
| $SiO_2$ | 800 | 135° |
| $Al_2O_3$ | 800 | 115° |
| Cenosphere* | 800 | 111° |
| Ni-coated cenosphere* | 800 | 55° |

*Calculated by equations. (1) and (2)

The average effective wetting angle for Ni-coated fly ash is approximately 55°. However, the average effective wetting angle for Ni-coated fly ash increased to about 114° when longer infiltration times were used, and the Ni-coating was dissolved in the molten aluminum during these extended infiltrations; this value is close to that of pure aluminum—uncoated fly ash system.

G. Density of Composites

The average density measured of aluminum—60 vol. % uncoated cenosphere fly ash composite samples made as described here was 1.2 g/cm$^3$. The calculated density value of the composite is in the range 1.32 g/cm$^3$ to 1.44 g/cm$^3$. The difference between the experimental data and the calculated results suggests that in addition to the porosity in the center of each individual cenosphere, porosity in the composite is present in an amount about 9 to 17 vol. %.

The average measured density of aluminum—55 vol. % nickel coated cenosphere fly ash composite samples made as described here was 1.4 g/cm$^3$. The calculated density value of this composite is in the range 1.45 g/cm$^3$ to 1.52 g/cm$^3$, suggesting that there may be porosity in the composite in an amount about 3 to 8 vol. % in addition to the porosities within the cenosphere particles.

Figure 5:
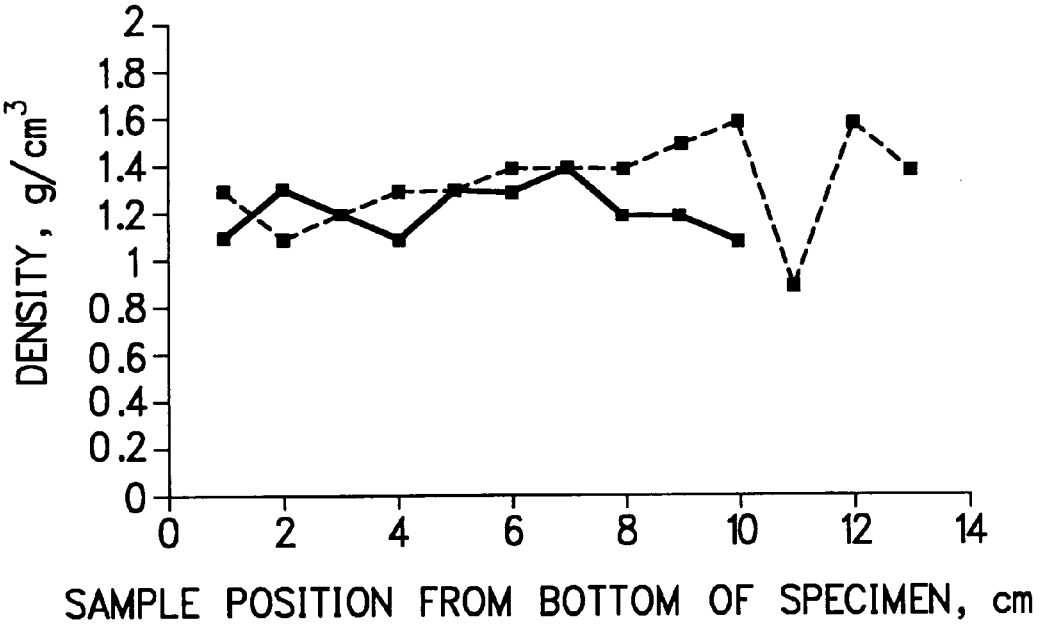
FIG. 5 is a plot of data showing the densities at various points along the length of aluminum-cenosphere fly ash composites according to the invention, made by infiltration of nickel coated fly ash (filled squares connected by broken lines, - - - ■ - - -) and of uncoated fly ash (filled squares connected by solid lines, —■—).

Density variations along the lengths of composite specimens made by aluminum infiltration of both uncoated cenosphere fly ash and Ni-coated cenosphere fly ash are depicted graphically in FIG. 5. The drop in density in the upper samples may owe to the fact that the infiltration front is nonplanar, and/or to a greater amount of porosity near the top. In any event, the aluminum-fly ash composites made in this study have much lower densities than aluminum alone.

As this Example shows, beds of uncoated and nickel coated fly ash cenospheres can be infiltrated by molten aluminum to produce aluminum—50—60 vol. % cenosphere fly ash composites which have sound microstructure except near the regions of contacting particles. The average density of aluminum—60 vol. % uncoated cenosphere fly ash composite samples is of the order of 1.2 g/cm$^3$, while the average density of aluminum—55 vol. % nickel coated cenosphere fly ash composite samples was on the order of 1.4 g/cm$^3$, as compared to a density of 2.7 g/cm$^3$ for the matrix aluminum. The threshold infiltration pressures for uncoated fly ash and nickel coated fly ash are lower than the values reported for practically all ceramics under conditions similar to those employed here. Under conditions described here, the threshold pressure for infiltration of aluminum into a packed bed of uncoated cenosphere fly ash of size 180–250 $\mu$m is approximately 6.89 kPa. Young-Laplace and Washburn equations used to calculate the effective contact angle from the threshold pressure indicate that the contact angle between uncoated fly ash and aluminum is around 111°, close to that of the other oxide ceramics. Nickel coating helps to reduce the presence of uninfiltrated agglomerates of fly ash in composites and it reduces the infiltration of aluminum into the cavities within the cenospheres. Nickel coating dissolves into the infiltrating stream of aluminum and is carried away from the bottom of the sample and is deposited as nickel rich plate shaped phases along the top of the sample. These nickel rich plate shaped phases are confirmed by X-ray diffraction to be $NiAl_3$. The overall nickel concentration increases from bottom of the sample to the top of the sample.

Other embodiments are within the following claims. For example, hollow spherical micron-sized particulate materials other than cenosphere fly ash can be successfully infiltrated at low pressures to make low density metal matrix composites according to the invention, including, for example, hollow glass microspheres, hollow carbon microspheres, and hollow silicon carbide microspheres.

Any of a variety of metals and metal allows may be used to construct the metal matrix in the composite by infiltration of a melt at low pressure into the packed loose particulate mass according to the invention, and each can be expected to produce composite materials having particular uses. Examples of suitable metals include, besides aluminum and lead, copper, zinc, manganese, magnesium, tin, iron, gold, silver, nickel, cobalt, and alloys containing these metals.

Any of a variety of materials may be used to coat the particulate materials, to improve their wettability in the particular molten metal or, where the particulate material includes substantial portions of hollow spheroidal particles, to help prevent invasion of the melt into the centers of the particles during infiltration, by sealing cracks and porosities in the surface of the microspheroids; these include, for example, metals and ceramics. Examples of suitable metals include, besides nickel, copper, aluminum, cobalt, tin, gold, silver, magnesium, and alloys of these metals. The coating metal or alloy may suitably include one or more metals the same as in the matrix. Examples of suitable ceramics include metal oxides, carbides, and nitrides, such as, for example, $Al_2O_3$, MgO, SiC, SiN, AlN, $SiO_2$.

All publications and patent applications cited in this specification are herein incorporated by reference as if each individual publication or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A method for making a metal matrix composite, comprising the steps of:

providing loose fly ash particles positioned in a container, said fly ash particles having a substantially spherical shape; exposing an end of the container to molten metal held in a vessel under pressure in the range from 2 kPa to 100 kPa for a time sufficient to effect infiltration of the fly ash particles by the molten metal, and permitting the infiltrated fly ash particles to cool.

2. The method of claim 1 wherein said fly ash particles comprise hollow microspheroidal particles.

3. The method of claim 1 wherein said fly ash is precipatator fly ash.

4. The method of claim 1 wherein said fly ash is cenosphere fly ash.

5. The method of claim 4 wherein said metal comprises one of aluminum or lead or an alloy of aluminum or of lead.

6. The method of claim 1 wherein said metal comprises a metal selected from the group consisting of aluminum, lead, copper, zinc, manganese, magnesium, tin, iron, gold, silver, nickel, cobalt, and alloys thereof.

7. The method of claim 1 wherein said pressure is less than 40 kPa.

8. The method of claim 1 wherein said exposing step includes the step of immersing the end of said container into said molten metal.

9. The method of claim 1 further comprising the step, prior to said contacting step, of applying a coating onto the surface of at least a portion of the fly ash particles.

10. The method of claim 9 wherein said coating alters the surface energy of the fly ash particles coated thereby.

11. The method of claim 9 wherein said coating comprises a metal.

12. The method of claim 11 wherein said metal comprises a metal selected from the group consisting of nickel, copper, aluminum, cobalt, tin, gold, silver, magnesium, and alloys thereof.

13. The method of claim 11 wherein said step of applying said coating comprises exposing a fluidized bed of said fly ash particles to a gas of a carbonyl of said metal, whereby decomposition of said carbonyl results in coating said fly ash particles with said metal.

14. The method of claim 11 wherein said metal comprises nickel.

15. The method of claim 9 wherein said coating comprises a ceramic.

16. The method of claim 14 wherein said ceramic comprises one of an oxide or a nitride or a carbide of a metal.

17. The method of claim 16 wherein said method comprises exposing a fluidized bed of said particles with a carbonyl of nickel, whereby decomposition of said carbonyl results in coating said particles with nickel.

18. The method of claim 9 wherein said pressure is less than 40 kPa.

* * * * *